US010113720B2

(12) United States Patent
Thiele et al.

(10) Patent No.: US 10,113,720 B2
(45) Date of Patent: Oct. 30, 2018

(54) ILLUMINATION MODULE HOLDING DEVICE

(71) Applicant: Vossloh-Schwabe Deutschland GmbH, Lüdenscheid (DE)

(72) Inventors: Juergen Thiele, Kierspe (DE); Christian Gerstberger, Menden (DE)

(73) Assignee: Vossloh-Schwabe Deutschland GmbH, Lüdenscheid (DE)

( * ) Notice: Subject to any disclaimer, the term of this patent is extended or adjusted under 35 U.S.C. 154(b) by 0 days.

(21) Appl. No.: 15/873,082

(22) Filed: Jan. 17, 2018

(65) Prior Publication Data

US 2018/0216801 A1 Aug. 2, 2018

(30) Foreign Application Priority Data

Jan. 31, 2017 (DE) ..... 10 2017 101 809

(51) Int. Cl.
*F21V 19/00* (2006.01)
*F21V 15/01* (2006.01)
(Continued)

(52) U.S. Cl.
CPC ..... *F21V 19/004* (2013.01); *F21V 15/01* (2013.01); *F21V 17/164* (2013.01); *F21V 19/0055* (2013.01); *F21V 23/06* (2013.01)

(58) Field of Classification Search
CPC .. F21V 19/004; F21V 19/0055; F21V 19/003; F21V 23/06; F21V 23/001;
(Continued)

(56) References Cited

U.S. PATENT DOCUMENTS 7,828,557 B2 11/2010 Vogt et al.
9,605,818 B2 * 3/2017 Trott ..... F21S 8/02
(Continued)

FOREIGN PATENT DOCUMENTS

DE 10 2008 005 823 B4 12/2013
DE 10 2016 207 140 A1 11/2016
WO WO 2014/198327 A1 12/2014

OTHER PUBLICATIONS

German Patent and Trademark Office, Office Action—German Application No. 10 2017 101 809.3, dated Aug. 28, 2017, 6 pages (in German).

*Primary Examiner* — Joseph L Williams
*Assistant Examiner* — Jose M Diaz
(74) *Attorney, Agent, or Firm* — Sunstein Kann Murphy & Timbers LLP

(57) ABSTRACT

An illumination module holding device for positioning and holding an illumination module against a base surface includes first and second housing parts. The first housing part has a positioning window, into which the illumination module is loosely inserted. Using fastening means, the first housing part is put on the base surface and determines the position of the illumination module. The second housing part has electrical connection sockets on it into each of which an electric line can be inserted and electrically and mechanically connected with a contact part associated with each of them, without using tools. Each contact part has a spring tongue. Making a latching connection between the two housing parts causes each of the spring tongues to come in contact with an associated contact surface on the illumination module, creating an electrical connection, and simultaneously exerts on the illumination module a compressive force against the base surface.

17 Claims, 6 Drawing Sheets

(51) Int. Cl.
*F21V 17/16* (2006.01)
*F21V 23/06* (2006.01)

(58) Field of Classification Search
CPC ..... F21V 23/02; F21V 17/164; F21V 15/01; F21V 29/20; F21V 29/70; F21V 17/00; F21V 19/00; F21V 19/0005; F21V 19/0015; F21V 19/0025; F21V 19/0035; F21V 19/0045; F21K 9/00; F21Y 2115/10
See application file for complete search history.

(56) References Cited

U.S. PATENT DOCUMENTS

| | | | | |
|---|---|---|---|---|
| 2012/0051056 | A1 | 3/2012 | Derks et al. | |
| 2016/0312984 | A1 | 10/2016 | Poorter et al. | |
| 2017/0268737 | A1* | 9/2017 | Holscher ..... | F21S 8/063 |

* cited by examiner

ILLUMINATION MODULE HOLDING DEVICE

This application claims the priority benefit of German patent application 10 2017 101 809.3, filed Jan. 31, 2017, the entire disclosure of which is hereby incorporated by reference herein.

TECHNICAL FIELD

The invention relates to an illumination module holding device to hold an illumination module, for example a semiconductor illumination module with one or more semiconductor lamps on a mounting surface or base surface.

BACKGROUND ART

DE 10 2008 005 823 B4 describes an illumination module holding device in which an illumination module with a star-shaped circuit board is screwed against a mounting plate with the help of a ring-shaped holding element. The holding element can have a fastening ring on it with a reflector insert. Thus, the illumination module is clamped in by a screw connection between the fastening part and the mounting plate.

WO 2015/021458 A1 discloses an illumination module holding device in which the illumination module is inserted into a ring-shaped housing on the back opposite the light emission side and clamped there. Adjacent to the light exit opening there are openings on the light emission side through which the housing can be screwed onto a base surface. A similar housing is also disclosed in DE 20 2016 101 385 U1.

Starting from the prior art, the goal of the invention can be considered to be creating an illumination module holding device that allows an appealing appearance while being simple to assemble.

SUMMARY OF THE EMBODIMENTS

The illumination module holding device according to an embodiment of this invention has a first housing part that has latching means. With the help of fastening means, the first housing part can be fastened to a base surface, for example a base surface of a lighting unit or a wall section or a heat sink. The first housing part has a positioning window that cuts through the first housing part. An illumination module to be installed can be inserted into the positioning window. The illumination module is positioned by the positioning window only at a desired place on the base surface and is not connected with the first housing part for common handling. An illumination module inserted into the positioning window lies on the base surface with a specified play with respect to the positioning window. There is no non-positive or frictional connection between the illumination module and the first housing part. If the first housing part would be removed from the base surface, the inserted illumination module would remain behind on the base surface. There are no means to produce a unit exclusively between the illumination module and the first housing part.

A second housing part has counterpart latching means, which are set up to produce a latching connection with the latching means of the first housing part. The second housing part has at least two electrical connection sockets on it.

Each connection socket is associated with an electrical contact part mounted on the second housing part. A part or a section of the contact part can form the electrical connection means of the connection socket. Every contact part has a spring tongue, which is elastically movable in a direction toward the positioning window or toward an illumination module that is inserted there, and away from the positioning window or the illumination module. When the two housing parts are connected and the illumination module is inserted in the positioning window, each of the spring tongues exerts a compressive force onto an associated electrical contact surface of the illumination module. This both produces an electrical connection between a connection socket in question and an associated contact surface, and also exerts a mechanical clamping force or compressive force onto the illumination module, pressing it against the base surface.

Therefore, the illumination module holding device gets by with few components that have to be handled during assembly, and can, in a preferred sample embodiment, be limited to the two housing parts, the existing contact parts, in particular two to a maximum of four contact parts, and the fastening means for putting the first housing part on the base surface.

As fastening means it is possible to use two or three fastening screws, for example. An illumination module can be quickly and simply positioned on the base surface and electrically and mechanically mounted with the help of the illumination module holding device. The mechanical compressive force that is exerted on the illumination module can be chosen to be relatively small. Parallel to the base surface, the illumination module is positioned by the positioning window—apart from existing, defined play—and can be slightly displaced by no more than the play. The compressive force is limited or determined by the elasticity of the contact parts. Unlike the case with screwing, accidental damage of the illumination module due to excessive fastening forces can be safely avoided.

Preferably components of the first housing part that project into the clear space in the positioning window do not reach over the illumination module. The first housing part does not obstruct light emission or electrical contact of the illumination module on its light emission side.

Moreover, it is preferred if the first housing part is free of electrical contact means to produce an electrical contact with the illumination module. Only once the connection is made between the two housing parts is an electrical contact also made.

Moreover, it is advantageous if every contact part has an electrical clamping arrangement arranged behind—in an insertion direction of the associated connection socket—a connection opening of the respective connection socket, this electrical clamping arrangement belonging to the electrical connection means of the connection socket. The clamping arrangement can have, for example, a clamping surface extending approximately in the insertion direction and a clamping leg extending at an angle to the clamping surface and at an angle to the insertion direction, or alternatively two clamping legs running at an angle to one another. At least one of the clamping legs can be movably or pivotably mounted at right angles to the insertion direction. An inserted end of the lead or an inserted plug contact of an electric line is clamped between the clamping leg and the clamping surface or between two clamping legs, simultaneously producing electrical contact. Alternatively, the clamping surface can also be arranged at an angle to the insertion direction. In all variant embodiments, a space between the clamping surface and the clamping leg or between two clamping legs decreases in the insertion direction from the connection opening of the connection socket toward the inside, for example in the shape of a cone. In one sample embodiment, the clamping surface is not designed to be elastically movable with respect to the inserted end of the lead or the inserted plug contact of an electric line. The at least one clamping leg is designed to be elastically movable and in particular pivotably movable with respect to the inserted end of the lead or the inserted plug contact of an electric line.

If the connection has been made between the two housing parts and if the illumination module has been inserted in the positioning window, it is preferred that an extensive area of the back surface of the illumination module, in particular its entire surface, lie against the base surface. The compressive force presses the back surface of the illumination module against the base surface, which makes it possible to achieve a good thermally conductive contact for heat dissipation. Optionally, the back surface can be on a thermally conductive layer, for example a thermally conductive foil, which belongs to the illumination module.

In a preferred embodiment, the positioning window of the first housing part is set up to hold a polygonal illumination module.

Moreover, it is preferred if the positioning window has at least one recess, e.g., at least at one of the corner areas. The recess is designed so that a distance between the positioning window and an inserted illumination module is greater there than it is at at least one positioning location outside the recess, for example, outside the corner area. The at least one recess can be used for improved handling, for example for insertion of the illumination module into the positioning window. Moreover, the corners of a polygonal illumination module can be sensitive to damage. The additional recesses, for example in all corner areas of the positioning window, securely avoids contact between the first housing part and the adjacent corners of the illumination module, and thus damage.

In one sample embodiment, at least one positioning projection can be present on the positioning window outside the recess and/or the corner areas, a distance between the at least one positioning projection of the positioning window and the inserted illumination module being minimal, so to speak defining the play with which the illumination module is positioned in the positioning window.

The second housing part can have a light exit opening. Adjacent to the light exit opening, the second housing part can have depressions on it, each of which is associated with a free end of a spring tongue. If the two housing parts have been connected and if the illumination module has been inserted in the positioning window, such a depression can lie opposite an electrical contact surface of the illumination module. The depression allows the spring tongues a sufficiently large spring travel, which is not limited by the second housing part. When the illumination module is installed, the spring tongues or their free ends each lie on the illumination module or on one contact surface. The distance of the free ends of the spring tongues from the base surface can vary as a function of the thickness of the illumination module. The depressions allow sufficient spring travel, even if the light exit opening of the second housing part and the light exit opening of the illumination module have no separation, or only a very small separation.

If the housing parts have been connected and if the illumination module has been inserted in the positioning window, it is preferable if the light exit opening is located at a small distance to the light emission side of the illumination module, without contact being made there. Alternatively, this can also be accomplished by inserting a sealing element between the light exit opening and the illumination module, for example if the housing is supposed to be designed to meet an ingress protection rating.

In a preferred sample embodiment, the light exit opening is completely surrounded in a peripheral direction by a reflector part. The reflector part is preferably an integral component of the second housing part. The peripheral direction extends about an optical axis of the illumination module.

Moreover, it is advantageous if the second housing part has a cover part that completely surrounds the reflector part in the peripheral direction. The reflector part and/or the cover part can be free of openings. In particular, the reflector part and the cover part are integral components of the second housing part. The reflector part's reflective surface facing the optical axis of the illumination module is preferably free of edges and/or steps.

In one embodiment, the illumination module holding device is designed so that the housing parts are free of means and/or openings to undo the latching connection. The latching connection is made once during assembly. The housing parts are not set up to allow the latching connection to be reopened. Alternatively, the first housing part and/or the second housing part can also have openings or handling means, with whose help it is possible to undo the latching connection between the latching means and the counterpart latching means.

When the two housing parts are connected, it is preferred that the second housing part covers the fastening means and/or the latching means. When the two housing parts are connected, the fastening means, the latching means, and the counterpart latching means are preferably arranged inside the housing, and are not visible from outside, which improves the visual appearance.

Moreover, it is advantageous if mechanical polarizing means are present. The mechanical polarizing means are set up to prevent an incorrect relative positioning between the illumination module and the first housing part and/or between the two housing parts. This reduces the danger of an incorrect electrical connection of the illumination module to an electrical energy source.

Advantageous embodiments of the invention follow from the dependent claims, the description, and the drawings. Preferred sample embodiments of the invention are explained in detail below using the attached drawings.

DETAILED DESCRIPTION OF SPECIFIC EMBODIMENTS

Figure 1:
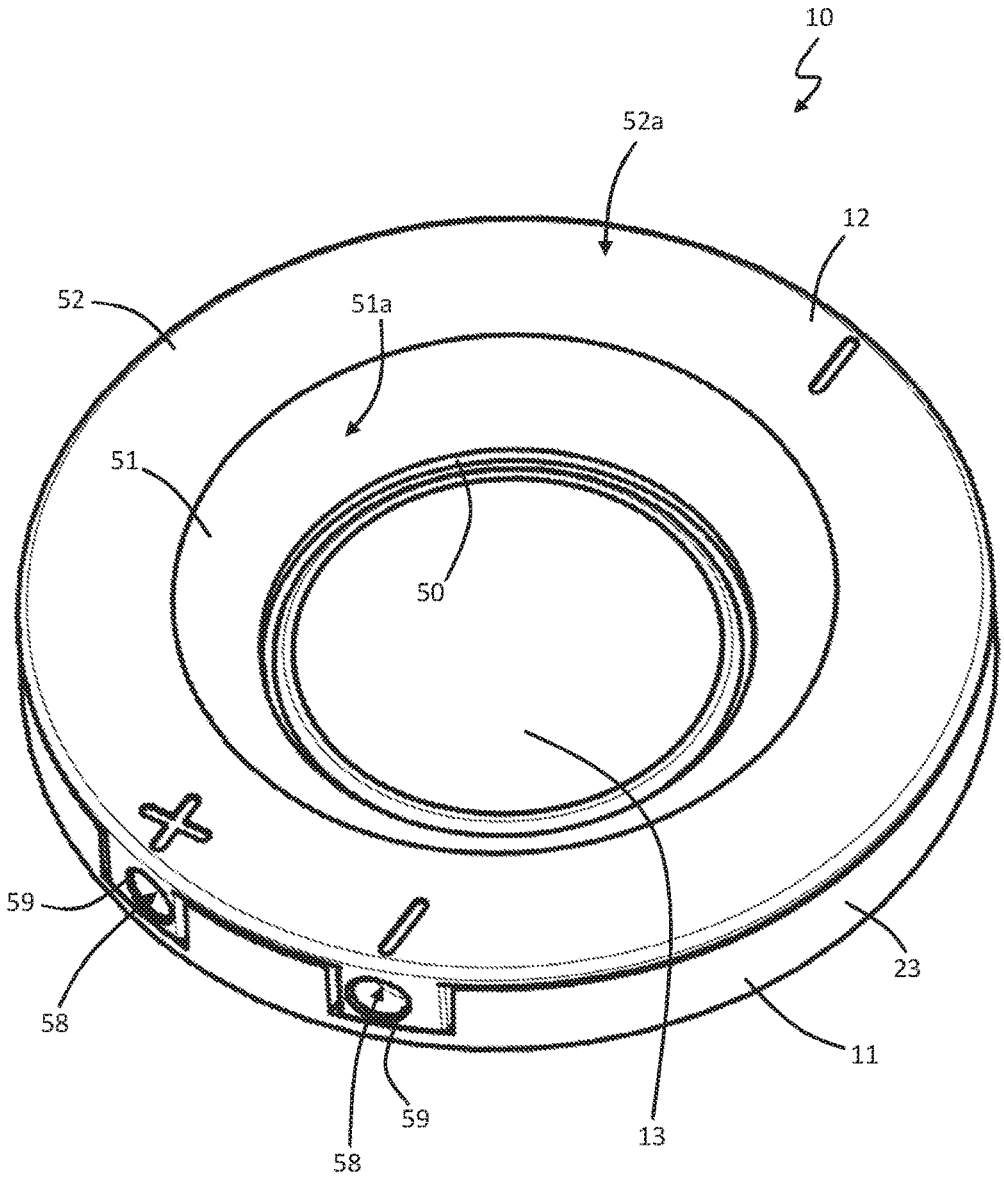
FIG. 1 A perspective representation of a sample embodiment of an illumination module holding device with a first housing part, a second housing part, and an installed illumination module when the connection has been made.
Figure 2:
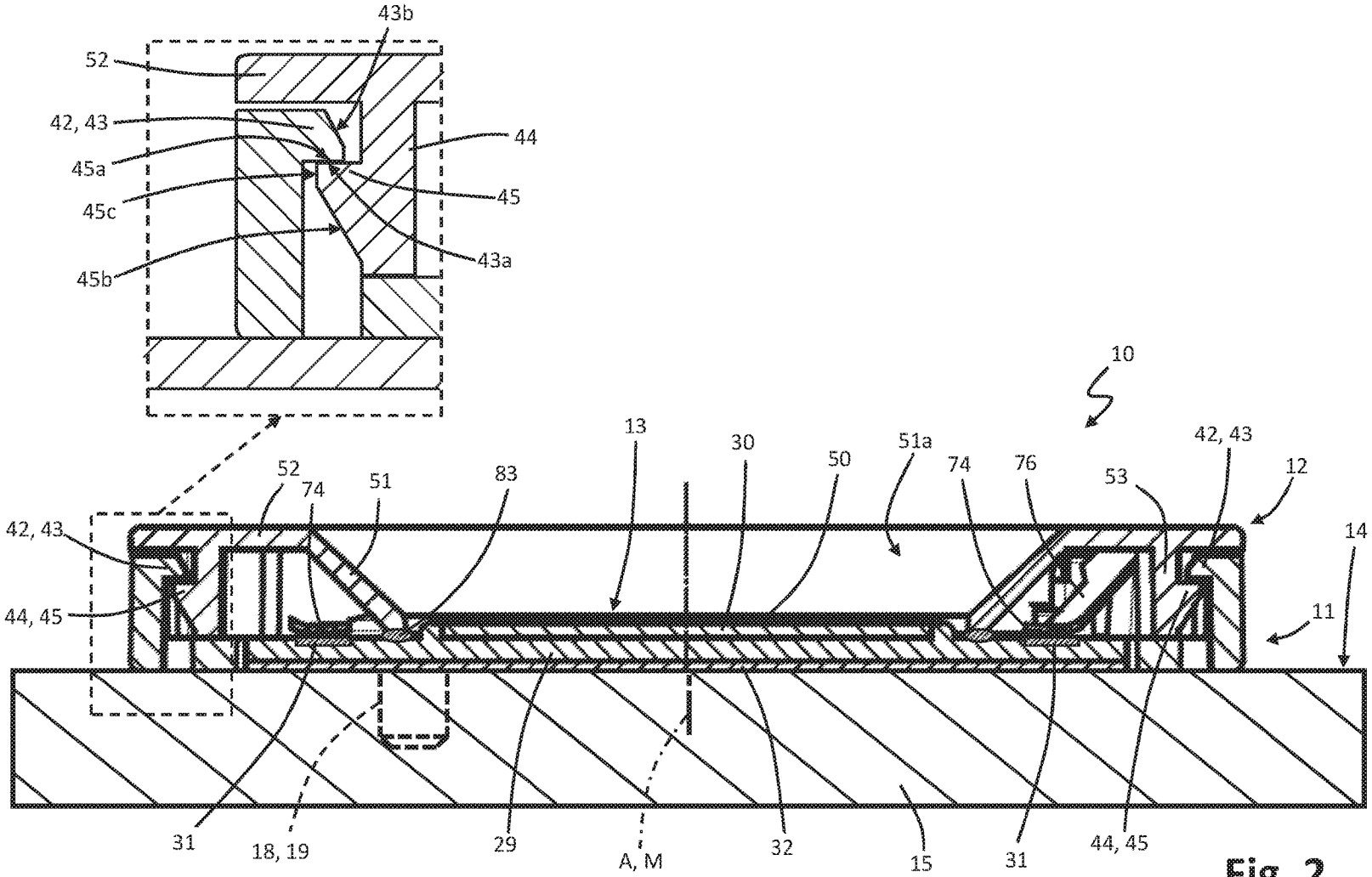
FIG. 2 A cross section through the illumination module holding device according to FIG. 1.
Figure 6:
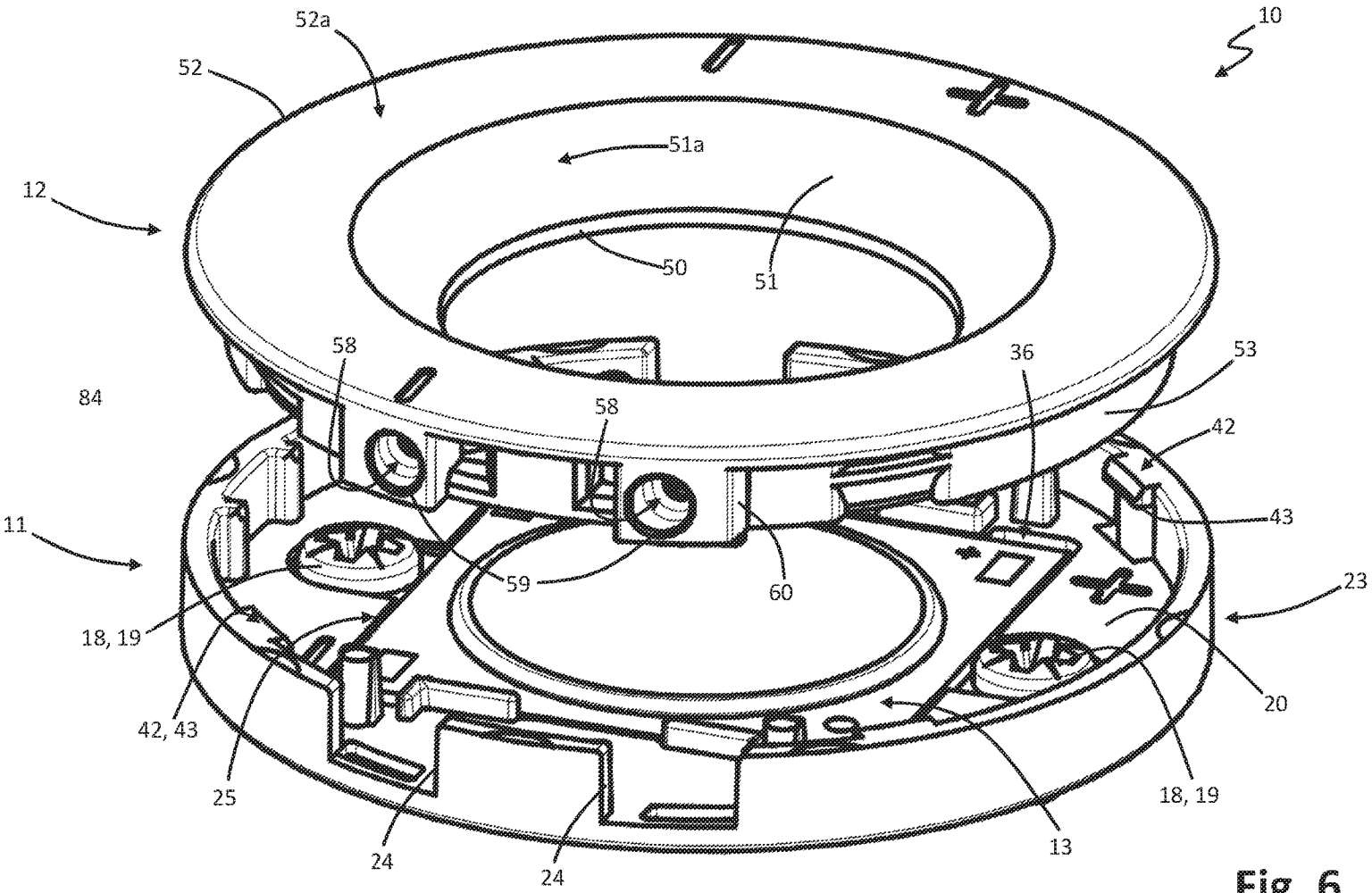
FIG. 6 An exploded perspective view of the illumination module holding device with the installed illumination module according to FIGS. 1 and 2.

FIGS. 1, 2, and 6 each show different representations of a sample embodiment of an illumination module holding device 10. The illumination module holding device 10 has a first housing part 11 and a second housing part 12. The illumination module holding device 10 serves to position an illumination module 13 on a base surface 14 of a base part 15. The base part 15 can be, for example, a component of a lighting unit and/or formed by a heat sink. Preferably the base part 15 has sufficiently good thermal conductivity and is made of metallic material or a metal alloy, for example.

The first housing part can be detachably fastened, with the help of fastening means 18, on the base surface 14 or on the base part 15. The fastening means 18 are formed, for example, by at least one fastening screw 19. For fastening, the first housing part has a base plate 20 with one fastening opening for every fastening screw 19. The screw head of the fastening screw 19 lies on the base plate 20 next to the fastening opening. Therefore, when the screw is connected with the base part 15, the base plate 20 is held clamped between the screw head of the at least one fastening screw 19 and the base surface 14.

The base plate 20 is surrounded on its outer edge by a strip-shaped wall 23. The strip-shaped wall 23 can have a lower ring that is completely closed in the peripheral direction and that lies against the base plate. In the sample embodiment, the strip-shaped wall 23 is subdivided into wall sections 23*a*, the example having four wall sections 23*a*. Immediately adjacent wall sections 23*a* have a wall opening 24 between them, which extends to the base plate 20. According to the example, the first housing part 11 has a circular contour with circular arc-shaped wall sections 23*a*.

In a central area, the base plate 20 of the first housing part 11 has a positioning window 25*f*, that completely cuts through the base plate 20. The illumination module can be inserted into the positioning window. The positioning window 25 is dimensioned so that it has a defined play between the illumination module 13 and the positioning window 25. If the illumination module 13 has been inserted into the positioning window 25 and if its back 13*b* opposite a light emission side 13*a* is lying on the base surface 14, it can be moved parallel to the base surface 14, according to the play between the illumination module 13 and the positioning window 25. Inserting the illumination module 13 into the positioning window 25 does not produce any connection between the first housing part 11 and the illumination module 13. There is no indirect or direct fastening of the illumination module 13 to the first housing part 11 to form a unit that allows the first housing part 11 and the illumination module 13 can be handled together. The exclusive function of the positioning window 25 is to specify the position of the illumination module 13 on the base surface 14.

Here it should be pointed out that the illumination module 13 can be built from multiple parts. According to the example, the illumination module 13 comprises a semiconductor support 29 one side of which, its top side, has one or more semiconductor lamps 30 arranged on it, for example, one or more light-emitting diode chips. The side of the semiconductor support 29 on which the at least one semiconductor lamp 30 is arranged forms the light emission side 13*a* of the illumination module 13. The semiconductor support 29 can be formed by a plate with two parallel surfaces.

In the sample embodiment, the semiconductor support 29 also has, on the light emission side 13*a*, one or more contact surfaces 31 for electrical contact. Preferably, the at least one electrical contact surface 31 is present exclusively on the light emission side 13*a*, next to the at least one semiconductor lamp 30.

Figure 3:
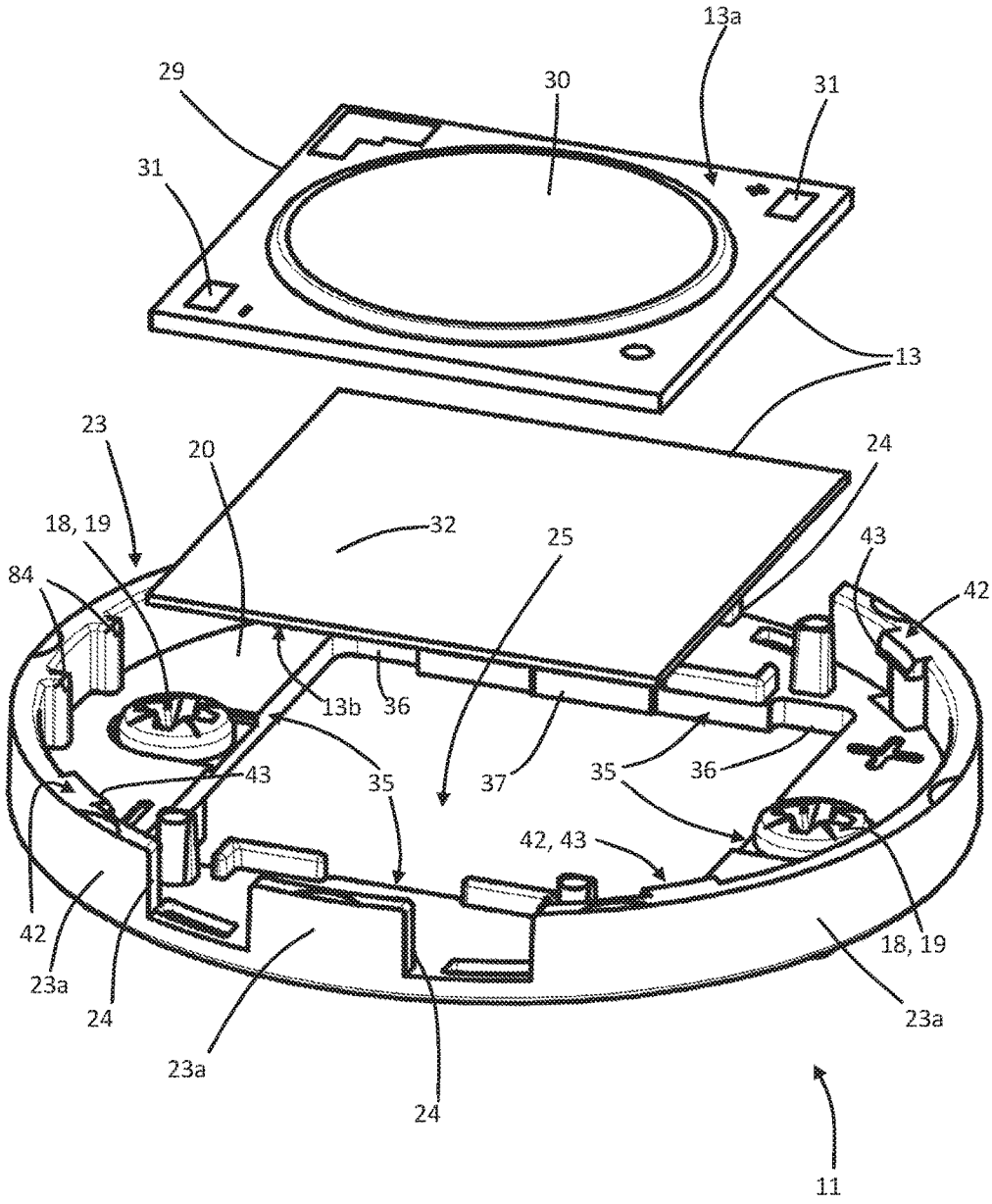
FIG. 3 A exploded perspective view of the first housing part according to FIGS. 1 and 2 and an illumination module.
Figure 4:
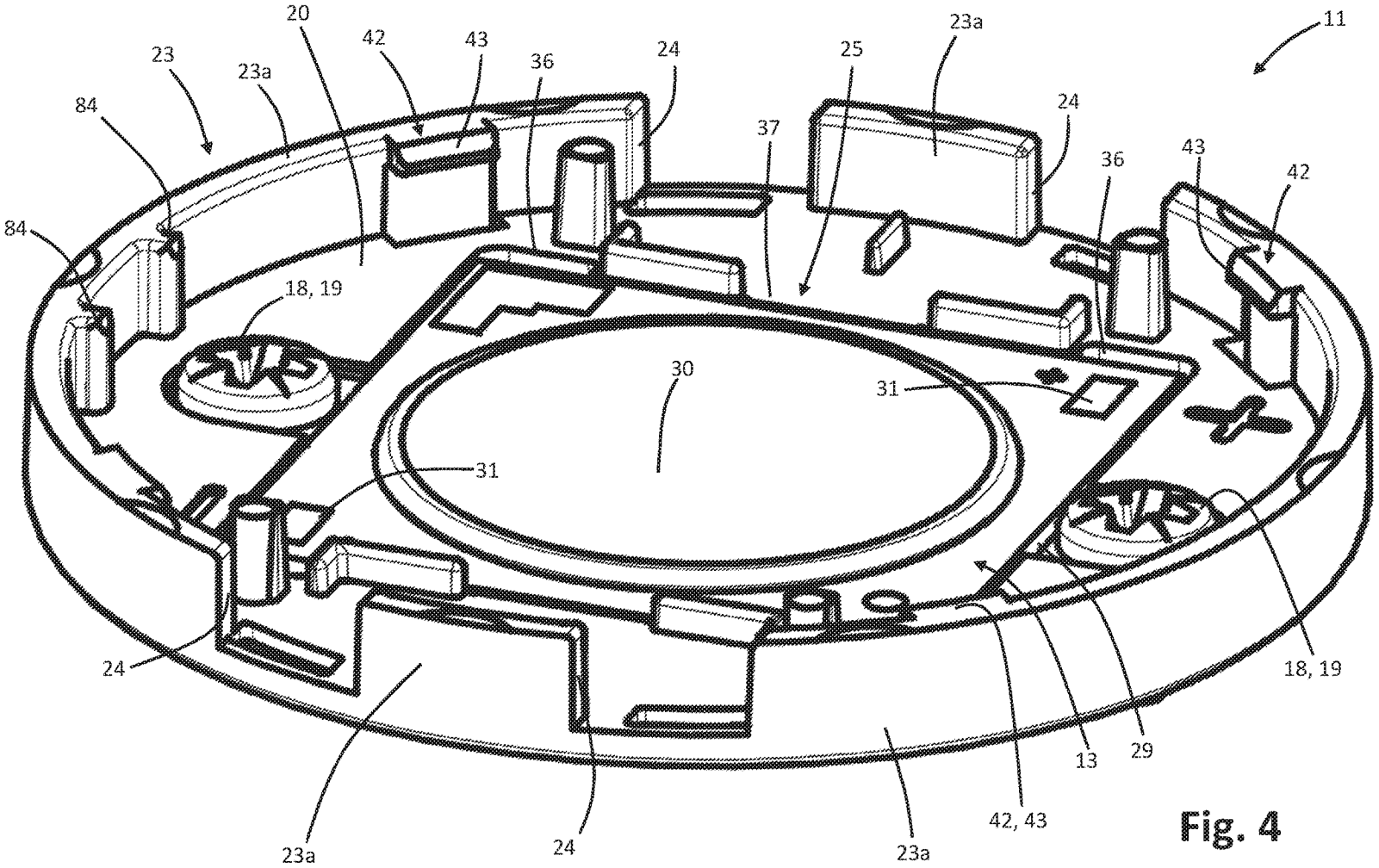
FIG. 4 The first housing part from FIG. 3 with illumination module inserted in a positioning window.
Figure 5:
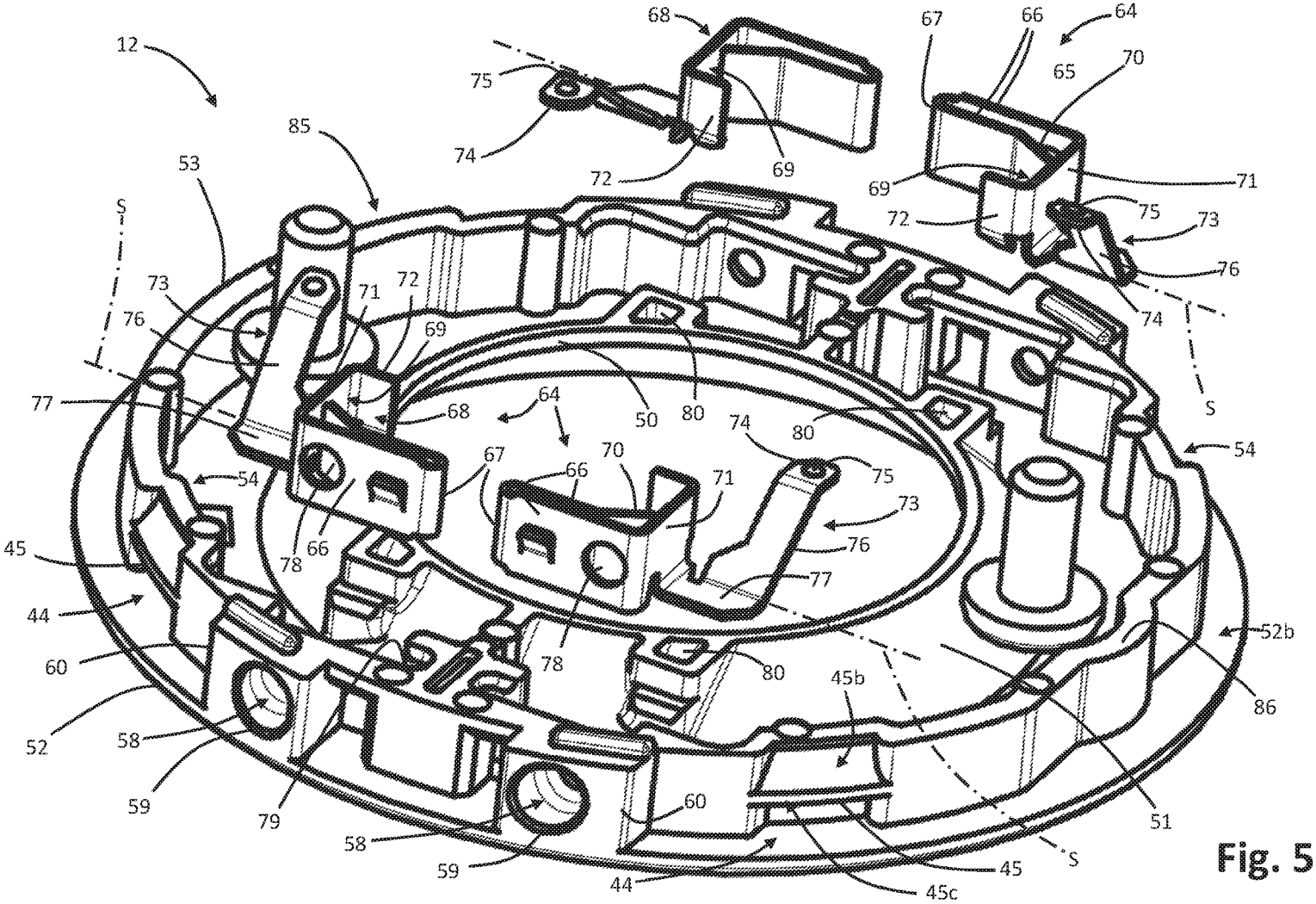
FIG. 5 The second housing part of the illumination module holding device according to FIGS. 1 and 2 in an exploded perspective view with four contact parts.

The lower side of the semiconductor support 29 opposite the light emission side 13*a* can form the back 13*b* of the illumination module 13. In the sample embodiment (FIGS. 2 and 3), the illumination module 13 also comprises a heat conduction foil 32, which lies against the bottom of the semiconductor support 29 and whose side opposite the semiconductor support 29 forms the back 13*b* of the illumination module 13, which lies against the base surface 14. Such an option heat conduction foil 32 can improve the heat conduction between the at least one semiconductor lamp 30 and the base part 15. Alternatively, the back 13*b* of the illumination module 13 can also be directly on the semiconductor support 29.

The contour of the positioning window 25 is adapted to the outer contour of the illumination module 13. In the sample embodiment, the illumination module 13 or the semiconductor support 29 is quadrilateral, in particular rectangular. Therefore, the positioning window 25 has four abutting lateral edges 35, which form a peripheral frame of the positioning window 25. Two immediately adjacent lateral edges 35 lie against one another in a corner area 36. Accordingly, the quadrilateral illumination module 13 according to the example has four corner areas 36. In one or more of the corner areas 36, the distance between an inserted illumination module 13 and the lateral edges 35 through a recess that is present is greater than at one or more positioning locations outside the corner areas 36.

At a positioning location between two immediately adjacent corner areas 36, one or more positioning projections 37 can be present. In the sample embodiment shown here, at least one of the lateral edges 35 has, between two adjacent corner areas 36, exactly one positioning projection 37 that has a section of the lateral edge 35 and is strip-shaped. On opposite sides of the positioning projection 37, the respective lateral edge 35 extends farther into the respective abutting corner area 36. At least two positioning projections 37 can be present, these positioning projections 37 being arranged opposite one another with respect to the window opening of the positioning window 25 and/or distributed around the window opening. The lateral edges 35, for example at a positioning projection 37, define the play that remains at the positioning locations between the inserted illumination module 13 and the positioning window 25 in a degree of freedom in question. For example, four positioning projections 37 arranged distributed around the window opening can form two pairs and limit the movement of the illumination module 13 in the degrees of freedom parallel to the base surface 14.

The positioning projections 37 do not reach over the illumination module 13. Thus, the illumination module 13 can be inserted into the positioning window 25 without hindrance after the first housing part 11 has been fastened by fastening means 18 to the base surface 14 or the base part 15. The base plate 20 on which the positioning projections 37 are formed extends essentially in the same plane as the illumination module 13 that has been inserted into the positioning window 25.

A variant of the described polygonal contour, which is, according to the example a rectangular contour, is for the illumination module 13 or its semiconductor support 29 and the positioning window 25 or its window recess also to be able to have any other shapes with lines and/or curved edges, for example a circular contour. If the contour is circular or if the radii of curvature are sufficiently large, there are no corner areas 36. At least one recess for handling can be present.

The first housing part 11 has latching means 42. The latching means 42 are formed by one or more latching projections 43, which project away from the wall 23 or the wall sections 23*a* at a distance from the base plate 20. In the first housing part 11, here with a circular contour and circular arc-shaped wall sections 23*a*, the latching projections extend radially away from the wall section 23*a* in question. In this embodiment the latching projections 43 project away, approximately radially inward, toward an optical axis A of an illumination module 13 inserted into the positioning window 25 or toward a central axis M of the housing formed from the housing parts 11, 12. It is preferable if the optical axis A and the central axis M coincide. According to the example, the latching projection 43 lies against the upper edge of the wall 23 or the wall section 23*a* opposite the base plate 20. According to the example, the latching projection 43 has a latching surface 43*a* that points downward toward the base plate 20 and is, according to the example, arranged in a plane that extends parallel to the base plate 20. The latching surface 43*a* is abutted by a sloping surface 43*b*, whose normal vector points away from the base plate 20, so that the latching projection 43 has an acute angle at its inner end between the sloping surface 43*b* and the latching surface 43*a* (FIG. 2).

According to the example, the first housing part 11, including the latching means 42, is integrally produced from a uniform material, without a seam or joint.

The second housing part 12 has counterpart latching means 44 associated with the latching means 42, each latching projection 43 of the first housing part 11 being associated with a counterpart latching projection 45. The counterpart latching projection 45 has a counterpart latching surface 45*a*, which extends, according to the example, in a plane that is oriented at right angles to the optical axis A and that is set up to lie against the latching surface 43*a* of the associated latching projection 43 when the latching connection between the two housing parts 11, 12 is made (FIG. 2). The counterpart latching projection 45 has, opposite the counterpart latching surface 45*a*, a sloping insertion surface 45*b* that can either directly border the counterpart latching surface 45*a* or that can, as in the sample embodiment, be connected with the counterpart latching surface 45*a* through an intermediate surface 45*c* extending parallel to the optical axis A or to the central axis M. When the housing parts 11, 12 are connected, the insertion surface 45*b* has a normal vector that slopes away from the optical axis A or the central axis M and toward the base plate 20.

The second housing part 12 has a light exit opening 50 whose contour is, in the sample embodiment, circular. The light exit opening can have essentially any contour, its selection being guided mainly by the arrangement of the at least one semiconductor lamp 30 on the semiconductor support 29. The form size of the light exit opening 50 is selected in such a way that the second housing part 12 does not shade the light emitted from the at least one semiconductor lamp 30. The light exit opening 50 is arranged through an opening in a reflector part 51, which conically widens according to the example. The reflector part 51 widens from the light exit surface 50 toward a cover part 52 that completely surrounds the reflector part 51 in a peripheral direction around the optical axis A or the central axis M; according to the example, the reflector part 51 has the shape of a circular annulus. The outside contour of the cover part 52 essentially corresponds to the outside contour of the wall 23. When the housing parts 11, 12 are connected, the outer peripheral edge area of the cover part 52 lies on the upper side or edge of the wall 23 or the wall sections 23*a* or reaches over them.

According to the example, the reflector part 51 and the cover part 52 and the counterpart latching means 44 are an integral component of the second housing part 12. The second housing part 12 is integrally produced from a uniform material, without a seam or joint.

The reflector part 51 has a reflective surface 51*a*, that serves to reflect the light emitted from the illumination module 13 at the desired emission angle. To improve the light reflection, it is possible to apply, to the reflector part 51, a color or layer that reflects light better than the other, second housing part 12. The reflective surface 51*a* lies against an outer surface 52*a* of the cover part 52.

A strip 53 projects away from an inner surface 52*b* opposite the outer surface 52*a* of the cover part 52. The strip 53 extends essentially at right angles to the plane in which the outer surface 52*a* and/or the inner surface 52*b* of the cover part 52 extends. The counterpart latching means 44, according to the example the latching projections 45, are formed on the strip 53. In the area of the latching projections 45, the strip has an offset 54, so that the latching projection 45 with the insertion surface 45*b* and the counterpart latching surface 45*a* can be formed within the offset. Preferably, the intermediate wall 45*c* abuts the outer wall of the strip 53 without a step. In the sample embodiment, the strip 53 is closed, running around the optical axis A in the peripheral direction.

The second housing part 12 has, at each of at least two or more places, a connection socket 58, each for electrical connection with one electric line. Each connection socket 58 has a connection orifice or connection opening 59, at which the connection socket 58 in question is accessible from outside when the two housing parts 11, 12 are connected. In the sample embodiment, the connection opening 59 according to the example is circular. Accordingly, the connection socket 58 can be cylindrical.

Each connection socket 58 is formed in a connection body 60 of the second housing part, at least partly following the connection opening 59. The connection body 60 projects away starting from strip 53 outward from the light exit opening 50 or the optical axis A and ends with the outer edge of the cover part 52. In the area between the strip 53 and the outer edge of the cover part 52 or the connection opening 59, the connection body 60 has an approximately rectangular cuboid contour.

According to the example, the second housing part has a contact part 64 arranged on it for every connection socket 58. At least two contact parts 64 are present, so that each of the two different voltages (positive and negative terminals) can have a contact part 64 associated with it. In the sample embodiment, four connection sockets 58 and, accordingly, four contact parts 64 are present. The contact parts 64 are electrically conductive and can be produced in the form of a stamped and bent part made of, e.g., a metallic material.

According to the example, the contact part 64 has a plug-in section 65 formed by two legs 66 that run parallel to one another and that are connected with one another by a bent section 67. The plug-in section 65 is abutted by a clamping arrangement 68 of the contact part 64 in question. According to the example, the clamping arrangement 68 is formed by a clamping surface 69 and a clamping leg 70 extending at an angle toward clamping surface 69. The clamping leg 70 follows one of the legs 66 and extends away from this leg 66 at an angle. The clamping surface 69 is present on a supporting section 71 of the contact part 64, this supporting section 71 following the respective other leg 66 of the plug-in section 65 and projecting away approximately at a right angle, so that the clamping surface 69 lies opposite the free end of the clamping leg 70. The supporting section 71 continues on the side opposite the leg 66 in a bent end piece 72 that borders, together with the leg 66, a space that follows the supporting section 71, the clamping leg 70 projecting into this space.

On the side opposite the clamping surface 69, the contact part 64 has a spring tongue 73 on the supporting section 71 that extends toward a free end 74 with a point of contact 75. The point of contact 75 can be formed by an elevation, for example a hemispherical elevation. Each point of contact 75 is set up to come in contact with an associated contact surface 31 of the illumination module 13, for electrical connection. Starting from the free end 74 with the point of contact 75, the spring tongue 73 has an intermediate section 76 running at an angle to the optical axis A or the central axis M, this intermediate section 76 being arranged on a connection section 77 so that it can pivot about a pivot axis S. The pivot axis S extends in a plane that is oriented at a right angle to the optical axis A or the central axis M. The connection section 77 is connected with the supporting section 71 and, according to the example, projects away parallel to the pivot axis S and preferably at a right angle from the supporting section 71 on the side of the supporting section 71 that is arranged adjacent to the inner surface 52*b* of the cover part 52.

The leg 66 of the plug-in section 65 directly abutting the supporting section 71 has an opening 78 allowing the insertion of an electrical plug contact or an electrical conductor of a line into the space between the clamping leg 70 and the clamping surface 69.

The plug-in section 65 of each contact part 64 is inserted into an associated insertion recess 79 on the second housing part 12. The insertion opening 79 lies against the respective contact part 64 in the area of the bent section 67, and against the leg 66 between the bend area 67 and the supporting section 71, and in the corner area between the supporting section 71 and the leg 66 in question. If the contact part 64 is inserted into the corresponding insertion recess 79, the free end 74 of the spring tongue is located in the area of the reflector part 51, separated from the light exit opening 50 in the direction radial to the optical axis A or the central axis M.

At each place where each free end 74 with the point of contact 75 is arranged, the reflector part 51 has one depression 80. This depression 80 in the reflector part 51 ensures that sufficient spring travel is provided for the spring tongues 73 or their free ends 74 when the housing parts 11, 12 are connected, if the contact points 75 or the free ends 74 come in contact with the illumination module 13. The depressions 80 are dimensioned so that when the illumination module 13 is inserted and when the housing parts 11, 12 are connected, the free end 74 and the second housing part 12 do not lie against one another in the direction of the elastic movement of the free end 74 of the spring tongue 73.

The illumination module 13 is installed by means of the illumination module holding device 10 described above as follows:

First, the first housing part 11 is put on the base surface 14 with the help of the fastening means 18, according to the example the fastening screws 19. The positioning window 25 defines the position of the illumination module 13 in the plane of the base surface 14. Then, the illumination module 13 is loosely inserted into the positioning window 25.

The contact parts 64 are inserted into the insertion recesses 79 on the second housing part 12. To make electrical contact with the illumination module 13, there are at least two contact parts 64, according to the example four contact parts 64. The second housing part 12 with the contact parts 64 is then put onto the first housing part 11 in the direction parallel to the optical axis A or to the central axis M, the latching means 42 and the counterpart latching means 44 forming a latching connection with one another (compare FIG. 2). After the latching connection has been made, the light exit opening 50 is located directly above the illumination module 13 and does not, according to the example, lie against the illumination module 13. As is schematically shown in FIG. 2, a sealing element 83 can be inserted between the reflector part 51 and the illumination module 13 in the area of the light exit opening 50, for example if the housing made of housing parts 11, 12 is supposed to be designed to meet an ingress protection rating.

When the latching means 42 and the counterpart latching means 44 have been latched together, the points of contact 75 of the free ends 44 of the spring tongues 73 each lie against the respective associated contact surface 31 of the illumination module 13 and are elastically deflected out of their unstressed resting position, according to the example pivoted about a respective pivot axis S. This causes the spring tongues 73 to exert a compressive force onto the illumination module 13 toward the base surface 14. This compressive force produces good electrical contact and mechanical holding of the illumination module 13 on the base surface 14. Moreover, this compressive force produces a good thermally conductive connection between the illumination module 13 and the base surface 14 and, consequently, the base part 15. As has already been explained, a heat conduction foil 32 can optionally be present for further improvement in heat transfer.

As can be seen, for example, in FIG. 1, each of the connection bodies 60 engages in the associated wall opening 24 on the first housing part 11. This means that the connection openings 59 are located approximately in the plane in which the outer surface of the wall 23 is located. The second housing part 52*a* has no openings other than the connection openings 58 and the light exit opening 50. The fastening means 18 and the latching means 42 and the counterpart latching means 44 are arranged inside the housing and covered by the second housing part 12 and the wall 23 of the first housing part 11, producing an appealing visual appearance. Moreover, the largely closed shape of the housing makes it simple to design it to meet the requirements of an IP rating, for example, dustproof, protected against sprayed water, or something of that kind.

After the latching connection between the two housing parts 11, 12 has been made, or alternatively even beforehand, every contact part 64 can be electrically connected with a respective electric line. To accomplish this, a conductive end of a respective line is inserted, in an insertion direction, into the associated connection socket 58 and enters into the space between the clamping leg 70 and the clamping surface 69. In this way, the electrically conductive end of the line is held clamped between the clamping leg 70 and the clamping surface 69, producing both a mechanical and an electrical connection. The contact part 64 produces an electrical connection between the respective line and the associated contact surface 31 of the illumination module 13. The insertion direction can be oriented at a right angle, for example radial to the optical axis A or to the central axis M.

Thus, the illumination module 13 can be connected, e.g., with a direct voltage source or a direct current source. To accomplish this, two electrical connections are sufficient. To allow, for example, multiple illumination modules 13 to be electrically connected in series and/or in parallel by means of the illumination module holding devices 10, it is also possible for three or four electrical connections or connection sockets 58 to be present.

Moreover, the preferred sample embodiment described here ensures that the two housing parts 11, 12 can only be connected or latched together in one rotational position about the optical axis A or the central axis M. To accomplish this, corresponding mechanical polarizing means are present. Such polarizing means can be realized in various possible ways. In the sample embodiment described here, the polarizing means comprise at least one polarizing projection 84 on the first housing part 11. According to the example, two polarizing projections 84 are present. The polarizing projections 84 are on the wall 23 or on one of the wall sections 23*a* adjacent to a fastening opening for a fastening screw 19, and project inward away from the wall section 23*a* in question, above the base plate 20, for example toward the optical axis A or the central axis M. Moreover, the polarizing means include the strip 53, which has a polarizing section 85 with a complementary shape. According to the example, outside the polarizing section 85 the strip 53 has the shape of a circular arc. In the area of the polarizing section 85, the course of the strip 53 is flattened, forming a free space for the polarizing projections 84 between the polarizing section 85 of the strip 53 and the wall 23 of the first housing part 11. When the latching connection has been made between the housing parts 11, 12, no such free space is present outside of the polarizing section 85. Therefore, the second housing part 12 can only be connected with the first housing part 11 in a rotational position in which the polarizing section 85 is arranged adjacent to the polarizing projections 84. In the sample embodiment described here, the polarizing projection 85 has a circular arc-shaped part 86, which goes around the screw head of the fastening screw 19 when the connection has been made and projects in between the two polarizing projections 84 of the first housing part 11.

Irrespective of the rest of the design of the illumination module holding device 10, these polarizing means 84, 85 ensure that the two housing parts 11, 12 are in a desired relative position or rotational position when they are connected. This allows components that are visible from outside, such as, e.g., the connection sockets 58 or the wall openings 24 to be symmetrically arranged about the optical axis A or the central axis M of the illumination module holding device.

The lines can be electrically connected the illumination module 13 without tools. It is unnecessary to make additional soldered connections, crimped connections, or connections of that kind.

Instead of the fastening means 18 formed by the fastening screws 19, it is also possible for other non-positive and/or form-fit connections, such as, for instance latching connections and/or plug-and-socket connections to be present. Fastening the first housing part 11 and the base surface 14 by a screw connection has the advantage that it is possible to dispense with an elaborate design of the base surface 14 or the base part 15, and only fastening openings need to be provided in the first housing part 11.

The inventive embodiment of the housing part 11, 12 has no openings or handling means to allow the latching connection to be undone, once it has been made. Alternatively to this embodiment, one of the two housing parts 11, 12 could also have openings through which it is possible to access the latching means 42 and/or counterpart latching means 44, so that once the latching connection has been made it can also be undone again with the help of a release tool.

The invention relates to an illumination module holding device 10 for positioning and holding an illumination module 13 against a base surface 14. The illumination module 13 has at least one semiconductor light source 30, for example a light-emitting diode chip. On its light emission side 13*a*, the illumination module 13 has two or more contact surfaces 31 for making electrical contact. The illumination module holding device 10 has a first housing part 11 with a positioning window 25, into which the illumination module 13 is loosely inserted, without a non-positive or frictional connection with the first housing part 11. Using fastening means 18, the first housing part 11 is put on the base surface 14 and determines the position of the illumination module 13. The second housing part 12 has electrical connection sockets 58 on it into each of which an electric line can be inserted and electrically and mechanically connected with a contact part 64 associated with each of them, without using tools. Each contact part 64 has a spring tongue 73. Making a latching connection between the two housing parts 11, 12 causes each of the spring tongues 73 to come in contact with an associated contact surface 31, creating an electrical connection, and simultaneously exerts on the illumination module 13 a compressive force against the base surface 14.

The invention claimed is:

1. An illumination module holding device comprising:

a first housing part that has latching means and that can be fastened to a base surface by fastening means, the first housing part having a positioning window into which an illumination module is inserted, without being held on the first housing part; and a second housing part that has counterpart latching means, which are set up to produce a latching connection with the latching means of the first housing part, the second housing part having at least two electrical connection sockets, each of which is associated with an electrical contact part arranged on the second housing part, each electrical contact part having a spring tongue that is elastically movable in a direction toward the positioning window and away from the positioning window and that is set up, if the two housing parts have been connected and if the illumination module has been inserted in the positioning window, to press with a compressive force against an associated electrical contact surface of the illumination module.

2. An illumination module holding device according to claim 1, wherein every contact part has an electrical clamping arrangement arranged behind—in an insertion direction of the associated connection socket—a connection opening of the respective connection socket.

3. An illumination module holding device according to claim 2, wherein every clamping arrangement has a clamping surface extending in the insertion direction and a clamping leg extending at an angle to the clamping surface and at an angle to the insertion direction.

4. An illumination module holding device according to claim 1, wherein if the connection has been made between the two housing parts and if the illumination module has been inserted in the positioning window, an extensive area of the back surface of the illumination module, this back surface facing away from the light emission side of the illumination module, lies against the base surface.

5. An illumination module holding device according to claim 1, wherein the positioning window of the first housing part is configured to hold a polygonal illumination module, the positioning window having a recess at each of its corner areas.

6. An illumination module holding device according to claim 5, wherein if the illumination module has been inserted in the positioning window, a distance between the positioning window and the illumination module at at least one recess is greater than it is at a positioning location outside the at least one recess of the positioning window.

7. An illumination module holding device according to 6, wherein the positioning window has, outside the at least one recess, at least one positioning projection at which, if the illumination module has been inserted in the positioning window, a distance between the positioning window and the illumination module is minimal.

8. An illumination module holding device according to claim 1, wherein the second housing part has a light exit opening.

9. An illumination module holding device according to 8, wherein the second housing part has depressions on it adjacent to the light exit opening, each of which is associated with a free end of a spring tongue.

10. An illumination module holding device according to 8, wherein if the connection has been made between the two housing parts and if the illumination module has been inserted in the positioning window the light exit opening is arranged at a distance from the illumination module.

11. An illumination module holding device according to claim 8, wherein the light exit opening is completely surrounded by a reflector part.

12. An illumination module holding device according to claim 11, wherein the second housing part has a cover part that completely surrounds the reflector part.

13. An illumination module holding device according to claim 12, wherein the reflector part is free of openings.

14. An illumination module holding device according to claim 13, wherein the cover part is free of openings.

15. An illumination module holding device according to claim 1, wherein the housing parts are free of means and/or openings to undo the latching connection.

16. An illumination module holding device according to claim 1, wherein when the two housing parts are connected, the second housing part covers the fastening means.

17. An illumination module holding device according to claim 1 further comprising mechanical polarizing means that prevent incorrect relative positioning between the illumination module and the first housing part and/or between the two housing parts.

* * * * *